US012245653B2

(12) United States Patent
Mazzarolo et al.

(10) Patent No.: US 12,245,653 B2
(45) Date of Patent: Mar. 11, 2025

(54) PROTECTIVE HELMET

(71) Applicant: ALPINESTARS RESEARCH S.P.A., Maser (IT)

(72) Inventors: Giovanni Mazzarolo, Coste di Maser (IT); Roberto Parissenti, Sedico (IT); Stefano Agostinetto, Galliera Veneta (IT); Paolo Visentin, Trevignano (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 64 days.

(21) Appl. No.: 18/548,707

(22) PCT Filed: Mar. 11, 2022

(86) PCT No.: PCT/IB2022/052200
§ 371 (c)(1),
(2) Date: Sep. 1, 2023

(87) PCT Pub. No.: WO2022/190051
PCT Pub. Date: Sep. 15, 2022

(65) Prior Publication Data

US 2024/0008580 A1 Jan. 11, 2024

(30) Foreign Application Priority Data

Mar. 12, 2021 (IT) ..... 102021000005984

(51) Int. Cl.
*A42B 3/12* (2006.01)
*A42B 3/32* (2006.01)

(52) U.S. Cl.
CPC ..... *A42B 3/127* (2013.01); *A42B 3/328* (2013.01)

(58) Field of Classification Search
CPC ..... A42B 3/127; A42B 3/328; A42B 3/306; A42B 3/14

(Continued)

(56) References Cited

U.S. PATENT DOCUMENTS 812,659 A * 2/1906 Lorsch ..... A42B 1/02 2/172
5,930,841 A * 8/1999 Lampe ..... A42B 3/00 2/421

(Continued)

FOREIGN PATENT DOCUMENTS

EP 3384794 A1 10/2018
EP 3479714 B1 6/2020

OTHER PUBLICATIONS

International Search Report and written Opinion for International Application No. PCT/IB2022/052200, mailed Jun. 20, 2022, 9 pg.

*Primary Examiner* — Timothy K Trieu
(74) *Attorney, Agent, or Firm* — Fredrikson & Byron, P.A.

(57) ABSTRACT

The present invention relates to a protective helmet (1) comprising: an outer shell (10); an impact absorbing liner (12), positioned inside the outer shell (10), and a comfort liner (14), positioned at an inner surface of the impact absorbing liner (12), so as to be in contact with the user's head during the use of the protective helmet (1). The comfort liner (14) comprises at least one cheek pad (16) including a padding layer (18) and a pad back plate (20). The at least one cheek pad (16) is coupled to the impact absorbing liner (12) by means of magnetic coupling means (22, 24) provided at the interface surface (P) between the pad back plate (20) and the impact absorbing liner (12). The magnetic coupling means comprise at least one projection (22), provided with a first magnetic element (26), designed to be inserted inside at least one recessed seat (24) in proximity of which a second magnetic element (28) is arranged. According to the invention, the at least one recessed seat (24) has a different size and shape with respect to said at least one projection (22). Said at least one projection (22) is adapted to move inside said at least one recessed seat (24) between a first (Continued)

position, wherein the first magnetic element (26) and the second magnetic element (28) are faced to each other, and a second position, wherein the first magnetic element (26) and the second magnetic element (28) are spaced apart, so that the pad back plate (20) is releasable from the impact absorbing liner (12).

15 Claims, 11 Drawing Sheets

(58) Field of Classification Search
USPC ..... 2/414
See application file for complete search history.

(56) References Cited

U.S. PATENT DOCUMENTS

| | | | | |
|---|---|---|---|---|
| 6,266,827 | B1 * | 7/2001 | Lampe | A42B 3/00 2/425 |
| 8,549,671 | B2 | 10/2013 | Sackett | |
| 2012/0174294 | A1 * | 7/2012 | Sackett | A42B 3/127 2/414 |
| 2012/0267297 | A1 * | 10/2012 | Iyer | C02F 1/445 210/636 |
| 2017/0196294 | A1 | 7/2017 | Fischer et al. | |

* cited by examiner

PROTECTIVE HELMET

RELATED APPLICATIONS

This application is a 35 U.S.C. 371 national stage filing from International Application No. PCT/IB2022/052200, filed Mar. 11, 2022, which claims priority to Italian Patent Application No. 102021000005984, filed Mar. 12, 2021. The entire contents of each of these applications is incorporated herein by reference in their entirety.

The present invention relates to a protective helmet. More specifically, the present invention relates to a protective helmet for sport activities, like for example motorcycle, motocross, car racing, cycling and skiing.

As it is well known in the art, the protective helmets, which are used during sport activities, are generally based on three primary components: an outer shell, an impact absorbing liner and a comfort liner.

The outer shell, made of a rigid material, for example a thermoplastic polymer, like polycarbonate or a fiber-reinforced polymer, has the function to protect the head of the helmet's user against impacts.

The outer shell is also suitable for dissipating, at least partially, in case of an accident, the impact forces acting on the helmet by transferring them to the second component of the helmet, the impact absorbing liner.

The impact absorbing liner is positioned inside and adjacent to the outer shell and it is dome shaped so as to correspond to the shape of the wearer's head.

The function of the impact absorbing liner is to absorb the impact forces which are generated during an accident, thereby preserving the user's head.

Generally, the impact absorbing liner is made of relatively rigid material, like for example expanded polystyrene.

The third component is the comfort liner which is positioned on the surface of the impact absorbing liner facing the user's head.

The comfort liner is usually made of a combination of soft foam and fabric materials and has the function to make the helmet comfortable, by avoiding that the user's head gets in direct contact with the relatively rigid impact absorbing liner.

Usually, the comfort liner comprises interior pads which are removably coupled by means of releasable fastening means to the impact absorbing liner.

These interior pads are removable from the impact absorbing liner both for maintenance reasons, for allowing the pads to be cleaned or washed and replaced after a certain period of use, and for safety reasons, for allowing the removal of the helmet without applying any traction force on the neck of the user in case of an accident.

Generally, the interior pads are fastened to the helmet by means of plastic or metal snaps.

For allowing an easy insertion and removal of the pads, in particular of the cheek pads designed to come into contact with the side parts of the face of the user, the use of magnetic coupling means have been recently introduced.

An example of such a type of coupling means is disclosed, for example, in U.S. Pat. No. 8,549,671.

In particular, U.S. Pat. No. 8,549,671 discloses a helmet wherein the cheek pads are fixed to the interior of the helmet by means of magnetic fasteners. Such magnetic fasteners comprise a riser and magnet provided on a pad back plate and a corresponding seat with ramped sides and embedded magnetic material provided on a helmet back plate applied at the inner side of the helmet. The riser of the pad back plate is designed to self-center with the seat of the helmet back plate when coupled to the helmet back plate.

The ramped sides of the seat provided in the helmet back plate enable the pads to be removed by a downward force applied to an emergency release strap fastened to the cheek pad and directed towards a bottom helmet opening.

Such a solution, even if appreciated, has some drawbacks.

First of all, the riser, provided on the cheek pad, and the seat with the ramped sides, provided on the helmet back plate, need to have same shape and dimensions for permitting the self-centering. Such an occurrence represents an obstacle when the cheek pad needs to be released in emergency situations.

As a matter of fact, a not negligible traction force needs to be applied on the emergency release strap to overcome the friction between the riser and the ramped side of the corresponding seat and to allow the riser to come out from its seat. Therefore, the risk exists that such a traction force might at least in part be transferred to the neck of the user, with the possible consequent problems from the safety point of view.

Moreover, the detachment force applied to the cheek pads needs to be directed towards the bottom of the helmet whereby the risers can come out from their seats. However, following the application of such a downward force, the cheek pads tend to move towards the face of the user and not towards the bottom of the helmet. Consequently, to remove the cheek pads a gap between the cheek of the user and the pad itself needs to be created in some way so as to allow the pad to slide towards the bottom of the helmet.

Obviously, also such an operation might result in a movement of the head of the injured user. This occurrence is very likely as the helmet usually fits snugly on the head of the user.

A further example of cheek pads fastened to the inner side of a helmet by means of magnetic fasteners is disclosed in EP3479714.

In particular, according to EP3479714 a helmet is provided with cheek pads which are fixable to/removable from the impact absorbing liner by means of magnetic coupling means suitable for cooperating with magnetic coupling means applied on the impact absorbing liner. Moreover, the cheek pads are provided with mechanical centering means that cooperate with corresponding mechanical centering means provided on the impact absorbing liner. The function of these centering means, which are spaced apart from the magnetic coupling means, is to speed up the fixing operations of the cheek pads to the impact absorbing liner.

However, the removal of the cheek pads, during emergency situations, has the same drawbacks mentioned above with respect to U.S. Pat. No. 8,549,671.

As a matter of fact, for the release of the cheek pad both magnetic and centering means must come out from their seats.

This result can be achieved if the cheek pad is moved towards the face of the user and not towards the bottom of the helmet.

Consequently, to remove the cheek pad necessarily a gap between the cheek of the user and the pad itself needs to be created in some way so as to allow the pad to slide towards the bottom of the helmet.

Moreover, the construction of the connecting means between the cheek pads and the helmet is complicated by the provision of separate centering means.

The main object of the present invention is therefore to provide a protective helmet configured to overcome or at least reduce the drawbacks mentioned above with reference to the known protective helmets.

More specifically, the main object of the present invention is to provide a protective helmet having magnetically coupled pads, configured to allow an easy removal of the pads in case of emergency.

Another object of the present invention is to provide a protective helmet having magnetically coupled pads, requiring a reduced traction force for releasing the pads in case of emergency. A further object of the present invention is to provide a protective helmet having magnetically coupled pads, configured to guarantee a firm connection between pads and helmet during the normal use.

Finally, an object of the present invention is to provide a protective helmet with magnetically coupled pads, having a simplified structure.

The above mentioned objects, and other objects that will better appear in the following of the present description, are achieved by a protective helmet according to claim 1.

The advantages and the characteristic features of the invention will appear more clearly from the following description of preferred, but not exclusive, embodiments of the protective helmet, illustrated in the accompanying figures in which.

Figure 2:
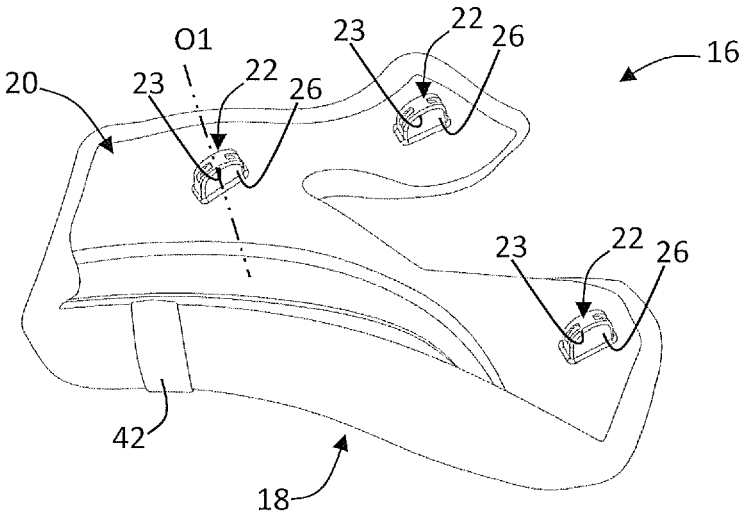
FIG. 2 shows a perspective rear view of a cheek pad of the protective helmet according to a first embodiment of the present invention.
Figure 3:
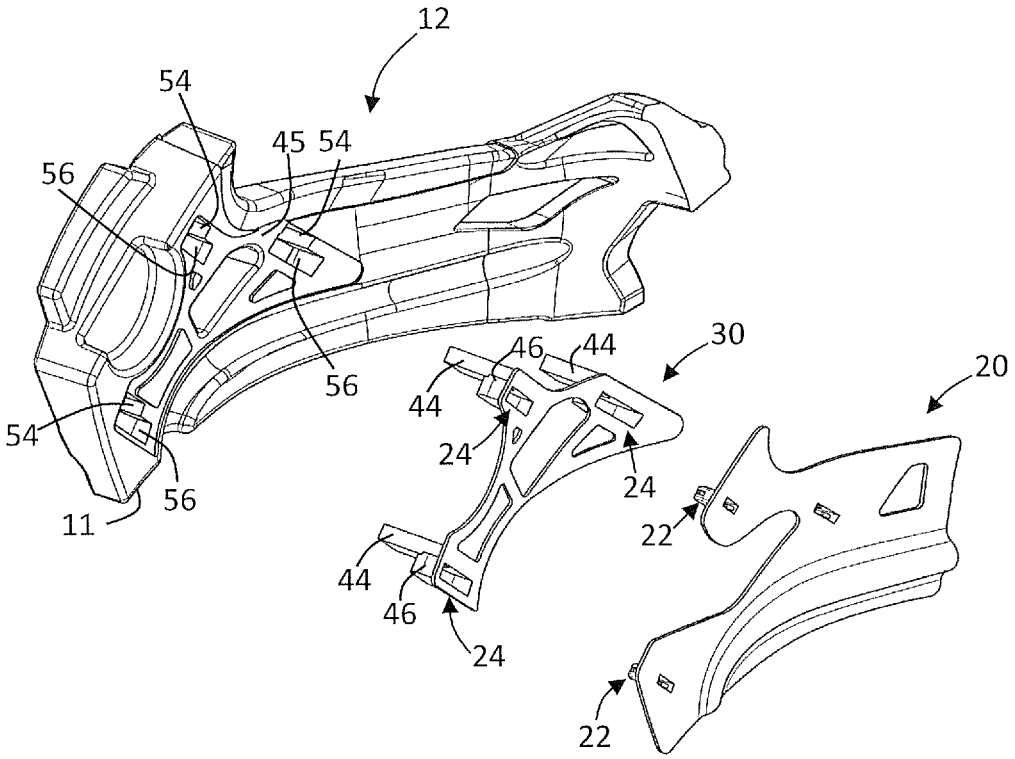
FIG. 3 shows an exploded view of details concerning the construction of the protective helmet of the present invention.
Figure 4:
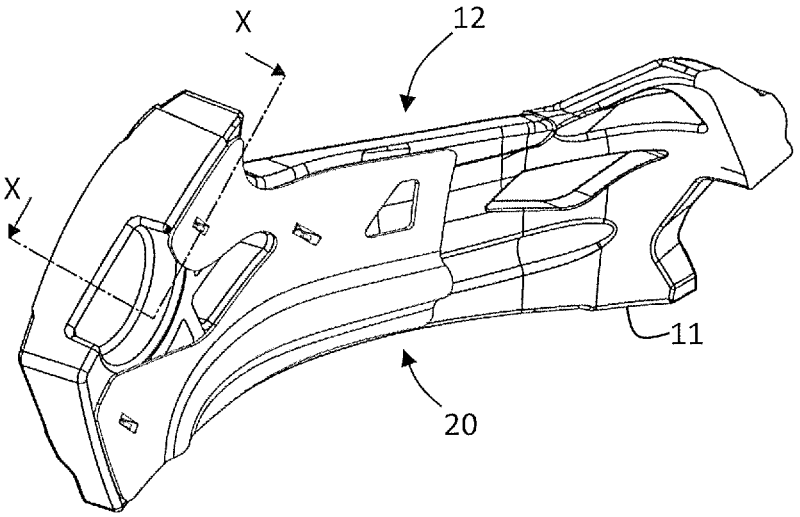
FIG. 4 shows a view similar to FIG. 3, wherein the various elements are assembled.
Figure 11:
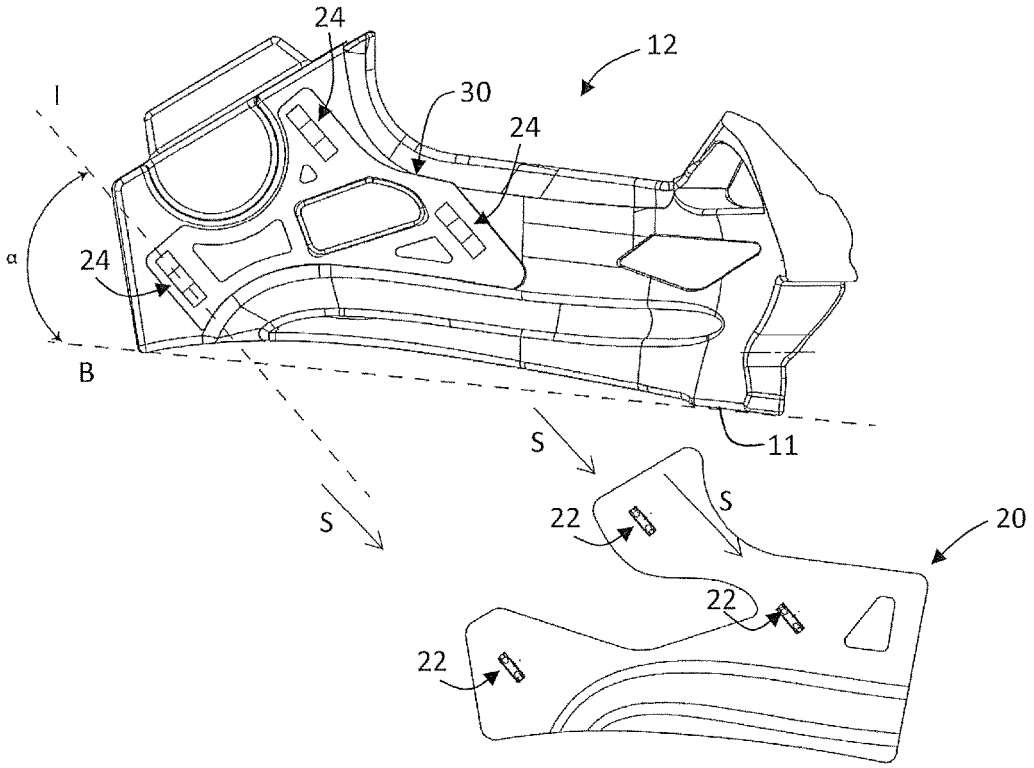
Figure 12:
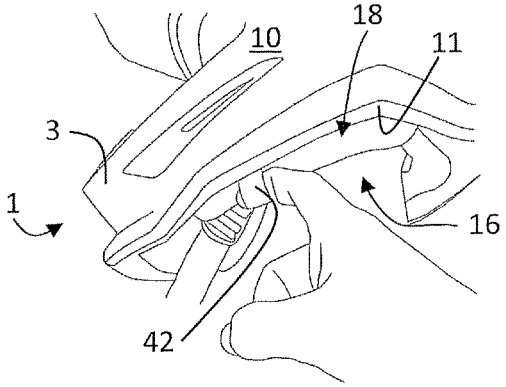
Figure 13:
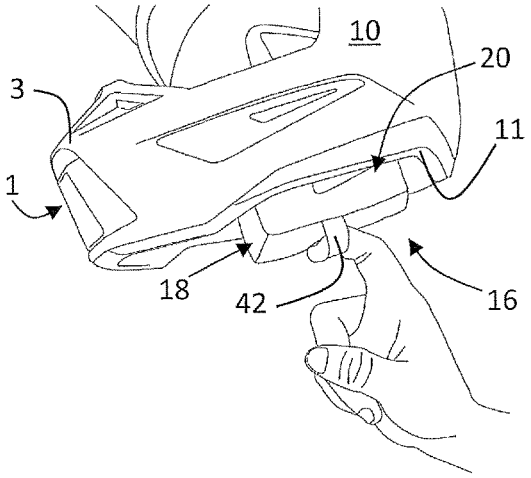
Figure 14:
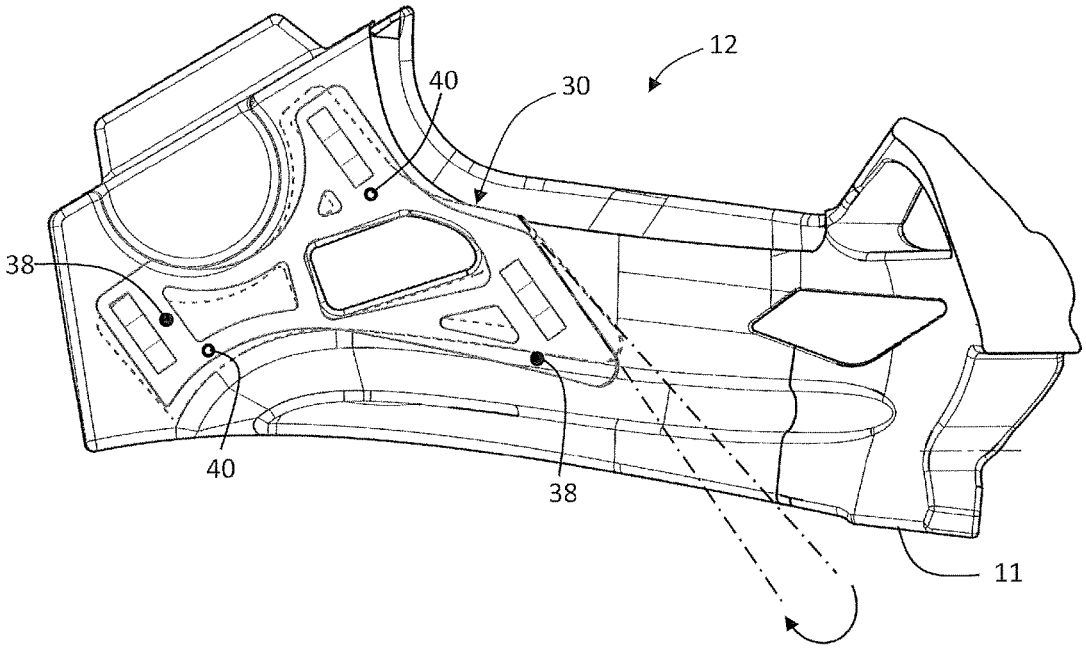
Figure 15:
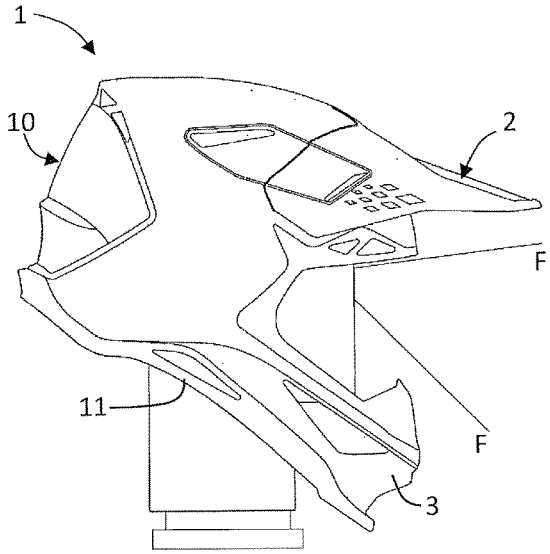
Figure 16:
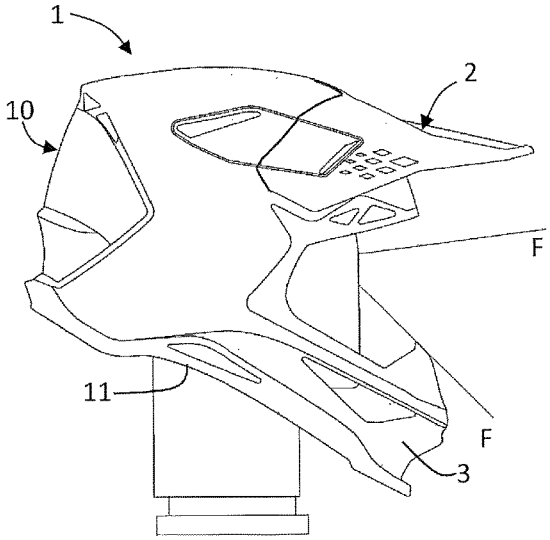
Figure 17:
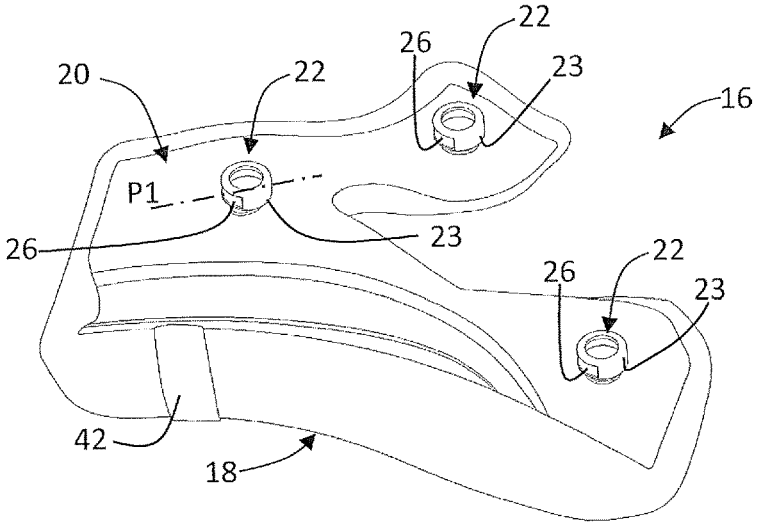
Figure 18:
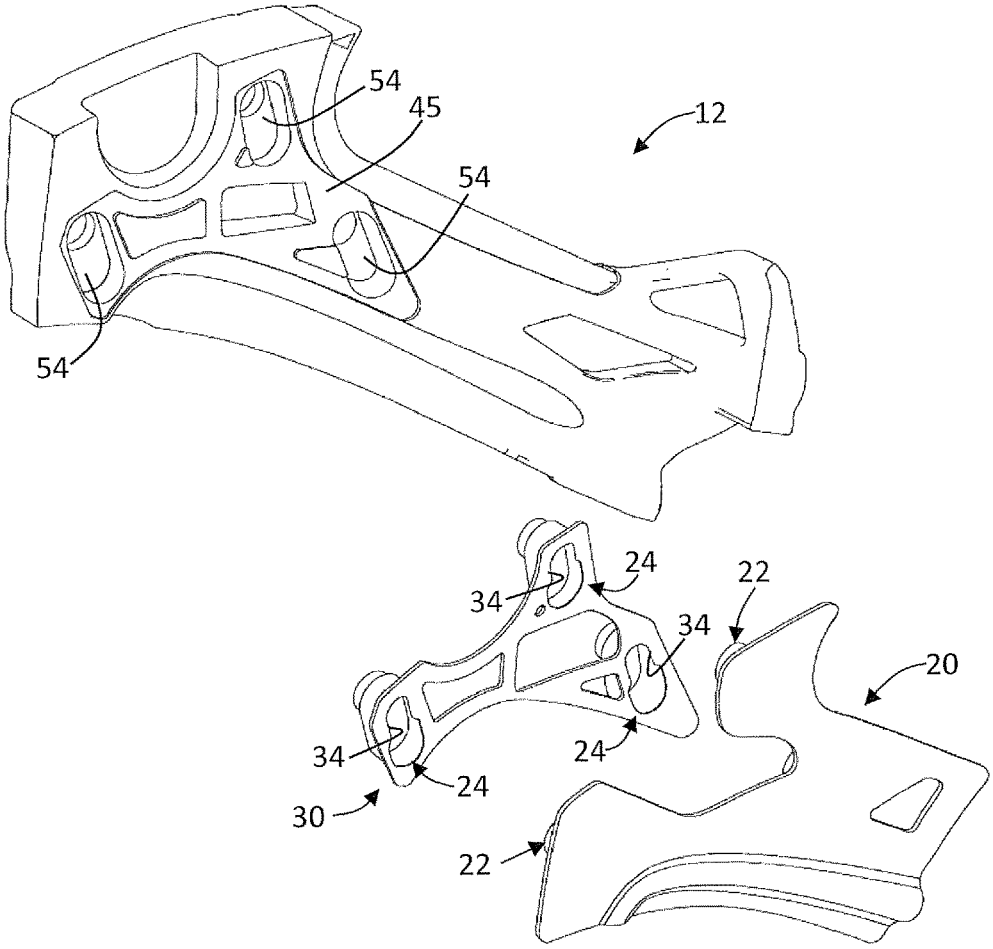
Figure 19:
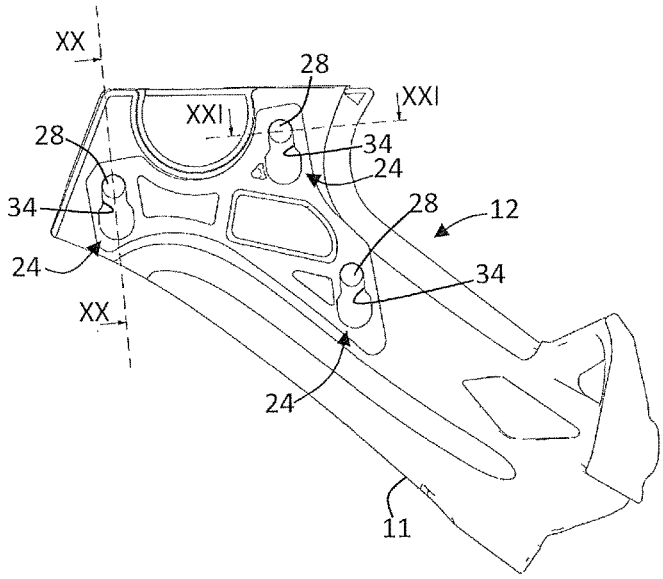
Figure 20:
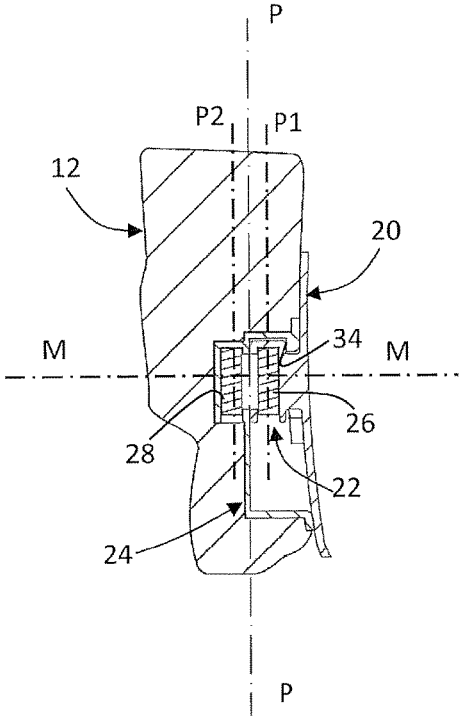
Figure 21:
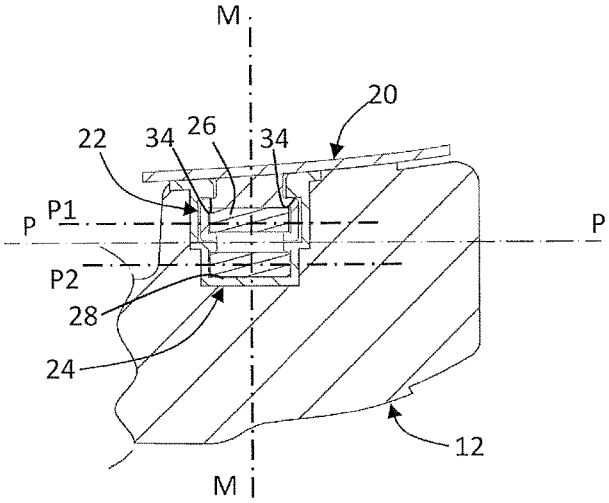
Figure 22:
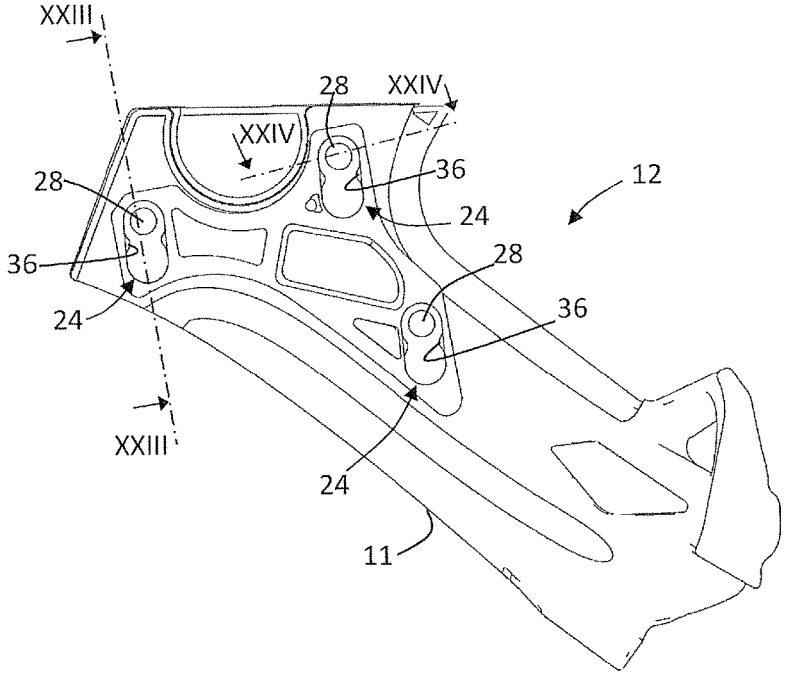
Figure 23:
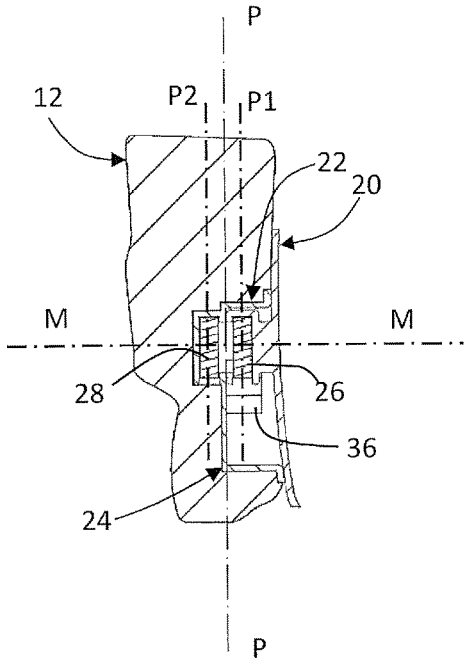
Figure 24:
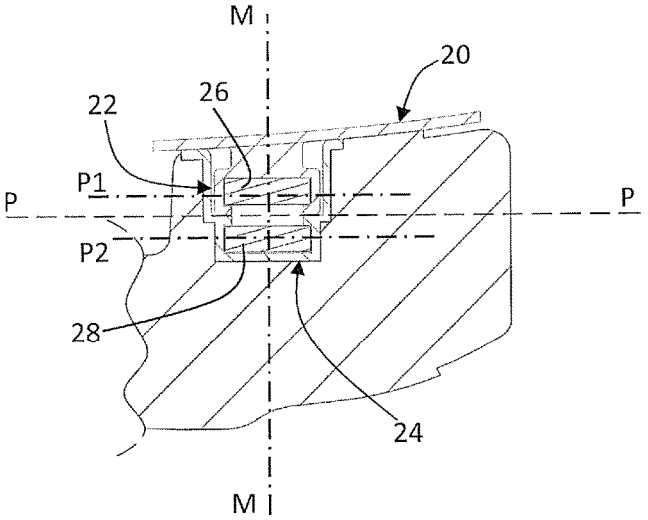
Figure 25:
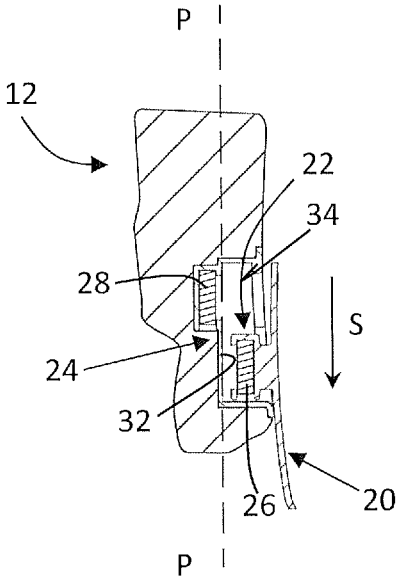
Figure 26:
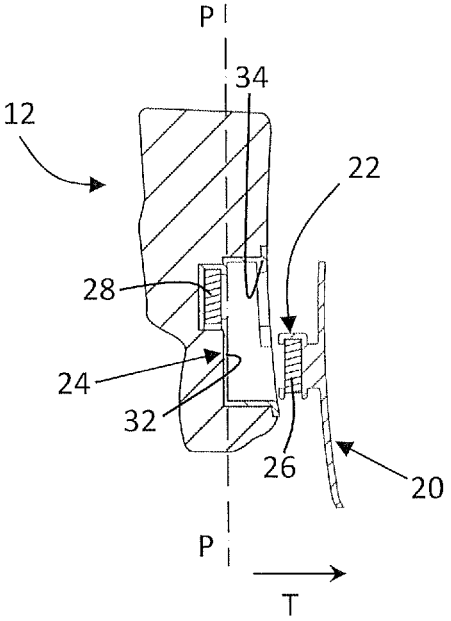
Figure 27:
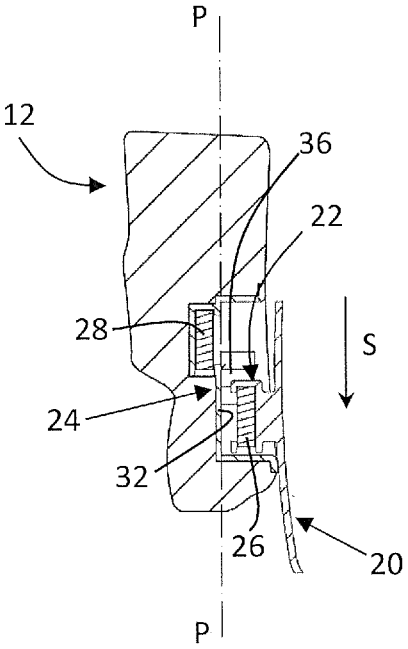
Figure 28:
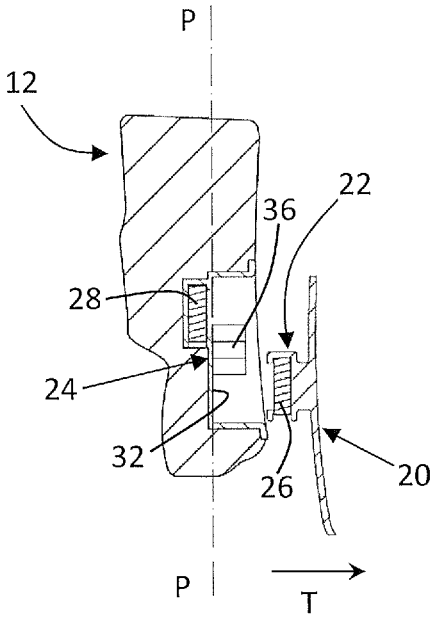
Figure 29:
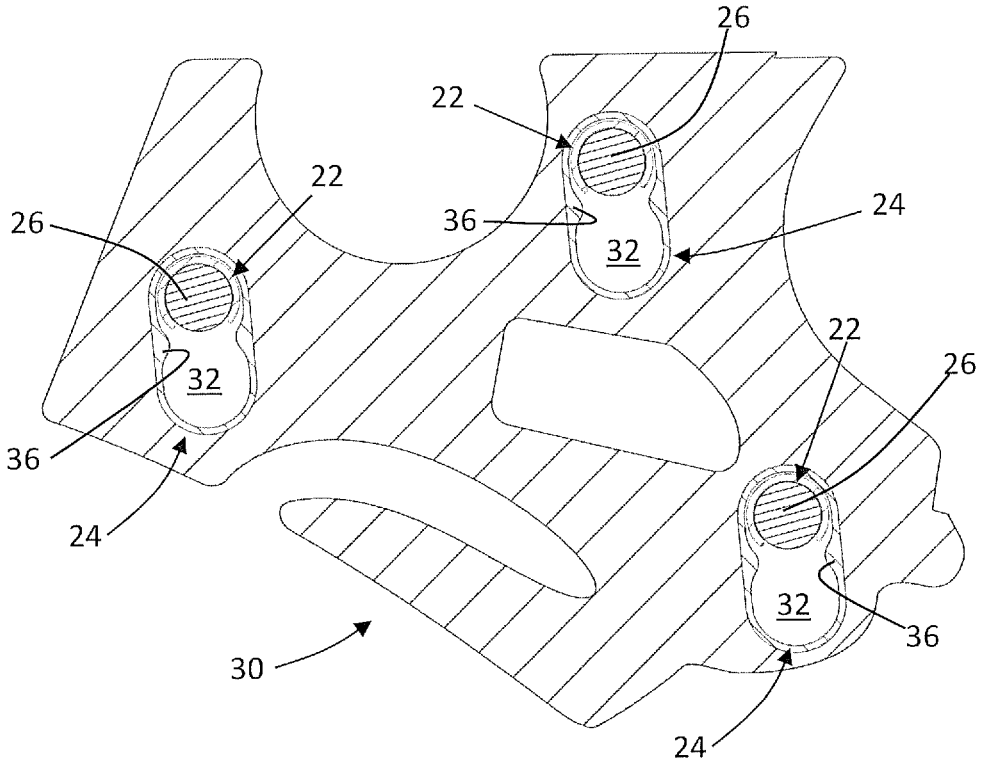

FIG. 11 schematically shows the directions along which the mutual movement between cheek pad and interior helmet takes place;

FIGS. 12 and 13 schematically show the actions needed for releasing the cheek pads from the protective helmet of the present invention;

FIG. 14 schematically shows how the positioning of the cheek pad with respect to the interior of the helmet can be varied;

FIGS. 15 and 16 schematically show how, by varying the positioning of the cheek pads with respect to the interior of the helmet, the position of the helmet over the user's head can be varied;

FIG. 17 is a figure similar to FIG. 2, but relating to a different embodiment;

FIG. 18 is a figure similar to FIG. 3, but relating to a different embodiment;

FIG. 19 shows a view similar to FIG. 18, wherein some elements are assembled;

FIG. 20 shows a cross section view taken along the line XX-XX of FIG. 19 wherein, for clarity reasons, the pad back plate has been added;

FIG. 21 shows a cross section view taken along the line XXI-XXI of FIG. 19 wherein, for clarity reasons, the pad back plate has been added;

FIG. 22 is a figure similar to FIG. 19, but relating to a different embodiment;

FIG. 23 shows a cross section view taken along the line XXIII-XXIII of FIG. 22 wherein, for clarity reasons, the pad back plate has been added;

FIG. 24 shows a cross section view taken along the line XXIV-XXIV of FIG. 22 wherein, for clarity reasons, the pad back plate has been added;

FIGS. 25 and 26 are figures similar to FIG. 20 and show schematically how the cheek pad of the embodiment of FIG. 20 can be released from the interior of the protective helmet;

FIGS. 27 and 28 are figures similar to FIG. 23 and show schematically how the cheek pad of the embodiment of FIG. 23 can be released from the interior of the protective helmet;

FIG. 29 schematically shows a detail of a further embodiment of the protective helmet of the present invention.

Figure 1:
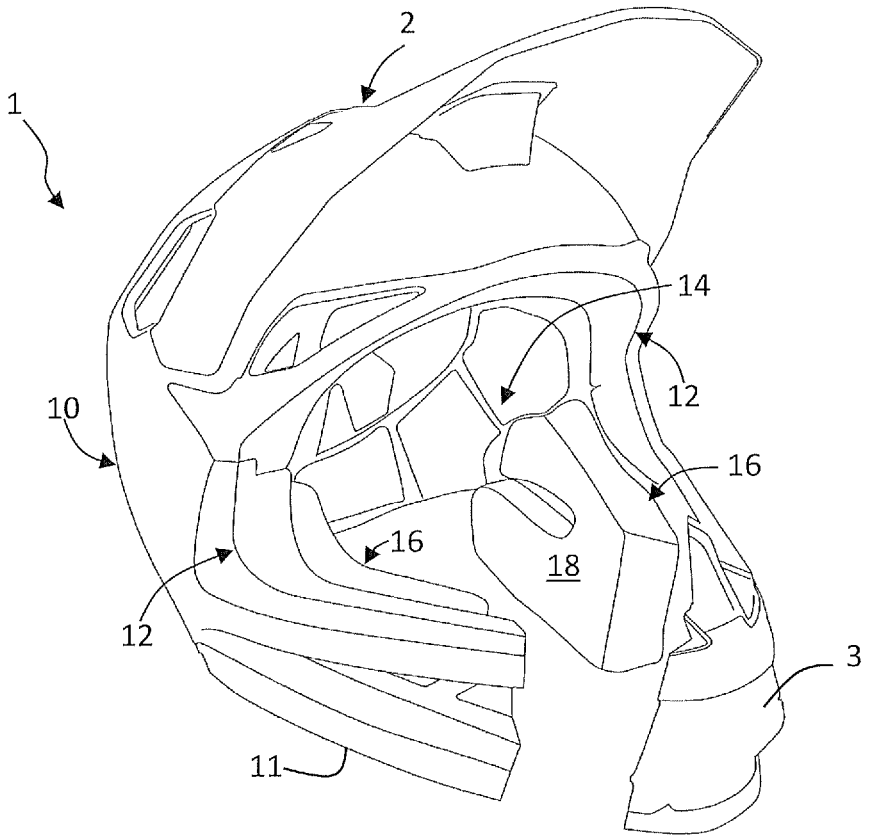
FIG. 1 shows, in schematic form, a perspective view of a protective helmet (with portions broken away) according to the present invention.

With reference to the attached figures, an example of a protective helmet according to the invention is indicated as a whole by the reference 1. Said protective helmet 1 is suitable for being used in particular by motorcyclists. Nevertheless, as it will appear more clearly from the following description, the protective helmet 1 can also be advantageously used by cyclists, skiers or in other fields where an effective protection of the user's head must be obtained. As shown in FIG. 1, the protective helmet 1 comprises an outer shell 10, which is preferably made of rigid material, for example thermoplastic polymer, like polycarbonate or a fiber-reinforced polymer. The outer shell 10 is preferably dome shaped so as to fit over the user's head.

The protective helmet 1 can comprise a visor 2 which is designed to be removably coupled to the outer shell 10 so as to project over a front opening of the outer shell 10.

The protective helmet 1 shown in FIG. 1 is also provided with a chin guard 3. However, the teachings of the present invention can also be advantageously applied to helmets which are not provided with a chin guard, namely the so-called "jet helmets".

As shown in FIG. 1, the protective helmet 1 also comprises an impact absorbing liner 12 which is positioned inside the outer shell 10. In detail, the impact absorbing liner 12 is designed to internally line the outer shell 10 for absorbing the energy of impact and offering an additional protection to the user's head.

Preferably, the impact absorbing liner 12 is made of expanded polymeric materials, for example expanded polystyrene, polypropylene or polyurethane.

Moreover, the protective helmet 1 comprises a comfort liner 14 positioned at an inner surface of the impact absorbing liner 12, so as to be in contact with the user's head during the use of the protective helmet 1. The comfort liner 14 can be made with synthetic foam, for example polyurethane foam pad, covered with a skin-friendly fabric.

The comfort liner 14 comprises at least one cheek pad 16. Preferably, the protective helmet 1 comprises two cheek pads 16 designed to be positioned on either side of the protective helmet 1.

The comfort liner 14 can comprise a further pad, the so-called "neck roll pad", which is in the form of a cylindrical foam piece that extends around the rear lower part of the helmet. Such a pad, which is not shown in the enclosed figures, is an integral part of the comfort liner 14. Each cheek pad 16 includes a padding layer 18 and a pad back plate 20 (see FIGS. 2 and 17). The pad back plate 20 is preferably made of polymeric material and it can be fastened to the padding layer 18 by means of mechanical fastening means, for example by means of stitchings, or by means of adhesive material.

Each cheek pad 16 is coupled to the impact absorbing liner 12 by means of magnetic coupling means 22, 24 provided at the interface surface between the pad back plate 20 and the impact absorbing liner 12 (see for example FIGS. 5, 8, 20-21 and 23-24).

The interface surface between pad back plate 20 and impact absorbing liner 12 is the surface which forms a common boundary between the pad back plate 20 and the impact absorbing liner 12 when the cheek pad 16 is coupled to the impact absorbing liner 12. The interface surface substantially corresponds to the contact surface between the pad back plate 20 and the impact absorbing liner 12 when the cheek pad 16 is coupled to the impact absorbing liner 12.

The magnetic coupling means 22, 24 comprise a projection 22 which is provided with a first magnetic element 26 (see for example FIG. 2). The projection 22 is designed to be inserted inside a recessed seat 24 in proximity of which a second magnetic element 28 is arranged (see for example FIGS. 6, 7 and 9).

First and second magnetic elements 26, 28 are elements capable of being magnetized or attracted by a magnet. In other words, first and second magnetic elements 26, 28 can be either a magnet or a ferromagnetic body.

According to the invention, the recessed seat 24 has a different size and shape with respect to the projection 22. In particular, the projection 22 is adapted to move inside the recessed seat 24 between a first position, wherein the first magnetic element 26 and the second magnetic element 28 are faced to each other, so that the pad back plate 20 is coupled to the impact absorbing liner 12 (see for example FIG. 5), and a second position, wherein the first magnetic element 26 and the second magnetic element 28 are spaced apart (see for example FIG. 6), so that the pad back plate 20 is releasable from the impact absorbing liner 12.

As it will appear clear from the following description, the mutual arrangement between the recessed seat 24 and the projection 22 permits to easily remove the cheek pads 16 from the helmet 12 during an emergency situation, so that the helmet 1 can be pulled off without exerting a traction force on the neck of the injured user.

As a matter of fact, by means of a tangential pull action on the cheek pad 16, it will be possible to move the projection 22 inside the recessed seat 24 until first and second magnetic elements 26, 28 are out of range and thus no magnetic attraction force exists between such elements and the cheek pad 16 is no longer attracted towards the impact absorbing liner 12 and it can be easily detached.

Due to the different shape and dimensions of the projection 22 with respect to the recessed seat 24, a reduced friction arises between the projection 22 and the seat 24. Consequently, differently from the known helmets, a lower force is required to allow the sliding of the projection inside the recessed seat and to detach the cheek pad from the helmet in case of emergency.

At the same time, during the normal use, the mutual arrangement between the projection 22 and the recessed seat 24 permits a firm connection between the cheek pad 16 and the impact absorbing liner 12, due to the magnetic attraction force between first and second magnetic elements 26, 28, so as to guarantee that the protective helmet 1 stays on the user's head in the correct position.

Preferably, as shown in the enclosed figures, the projections 22 are provided at the back pad plate 20 and the corresponding recessed seats 24 are provided at the impact absorbing liner 12.

However, in different embodiments, the projections 22 can be provided at the impact absorbing liner 12 and the corresponding recessed seats 24 can be provided at the back pad plate 20.

In the following, reference will be made to the embodiments wherein the projections 22 are applied at the pad back plate 20 of the cheek pad 16. However, the same notes are also valid for the embodiments wherein the projections 22 are applied at the impact absorbing liner 12. As shown in FIGS. 2 and 17, the projections 22 can extend from the pad back plate 20 in a direction opposite to the padding layer 18.

Preferably, each cheek pad 16 is provided with three projections 22 spaced from each other over the pad back plate 20.

However, the number and positions of the projections can be varied according to specific needs.

Advantageously, the first magnetic element 26 is inserted inside a slot 23 provided in the projection 22. The slot 23 is preferably shaped so as not to fully cover the face of the first magnetic element 26 designed to be faced to the second magnetic element 28 of the impact absorbing liner 12.

In a first embodiment shown in FIG. 2, the first magnet 26 of the projection 22 lays on an axis O1 essentially orthogonal to the pad back plate 20.

Figure 10:
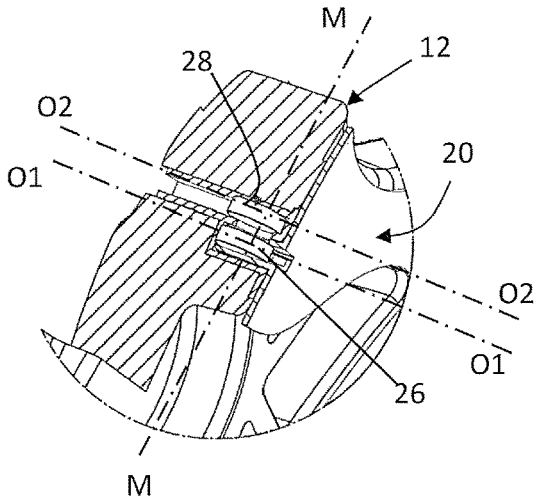
FIG. 10 is a schematic cross section taken along the line X-X of FIG. 4.

Consequently, as it is clearly shown in FIG. 10, the second magnetic element 28, arranged in proximity of the recessed seat 24, lays on an axis O2 essentially orthogonal to the outer surface of the impact absorbing liner 12. The axis O2 is thus parallel to the axis O1.

In this embodiment, the magnetic attraction axis of the first magnet 26 and the magnetic attraction axis of the second magnetic element 28 are parallel to the interface surface between the pad back plate 20 and the impact absorbing liner 12.

Consequently, the magnetic attraction force between the first magnetic element 26 and the second magnetic element 28 is directed along an axis M which is parallel to the interface surface between the pad back plate 20 and the impact absorbing liner 12 (see FIG. 10). The axis M is orthogonal to the axes O1 and O2.

In this embodiment the recessed seat 24 preferably consists in a groove having a width substantially equal to the thickness of the projection 22 so as to permit that the first magnetic element 26, during the movement of the projection 22 between the first position and the second position, maintains its orientation with respect to the second magnetic element 28. At the same time, the recessed seat has a length which is greater than the length of the projection.

Figure 5:
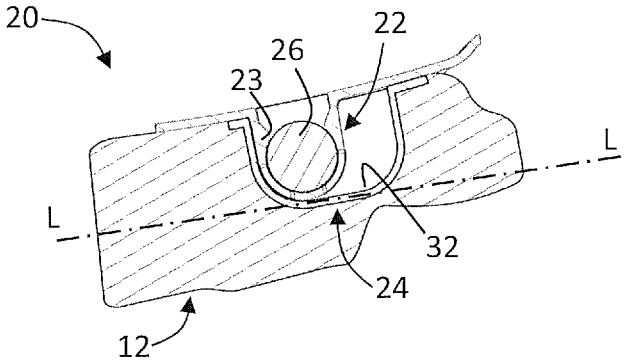
FIG. 5 shows a schematic cross-section of a detail of the coupling between the cheek pad and the interior of the protective helmet according to a first embodiment of the present invention.
Figure 6:
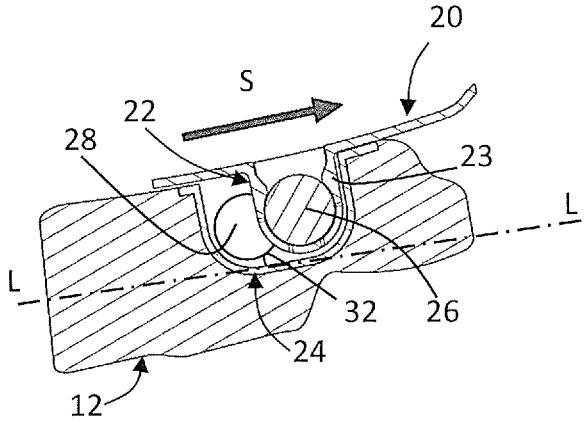
FIGS. 6 and 7 are figures similar to FIG. 5 and show schematically how the cheek pad can be released from the interior of the protective helmet.
Figure 7:
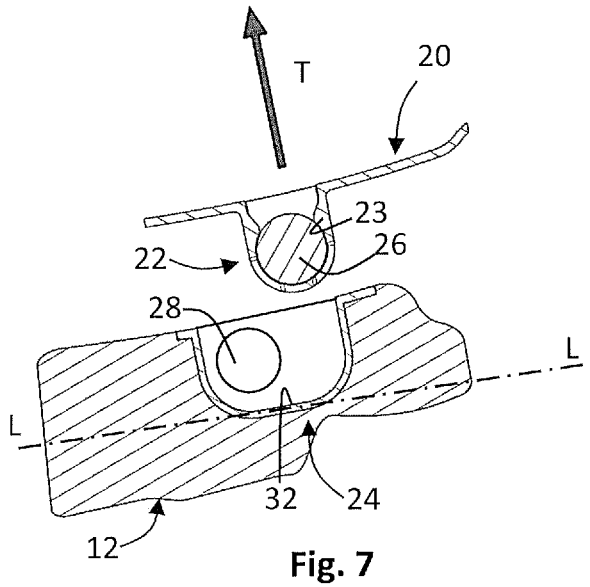

Preferably, as it is clearly shown in FIGS. 5-7, the recessed seat 24 has a bottom wall 32 which lays on a plane L substantially parallel to the interface surface between the pad back plate 20 and the impact absorbing liner 12.

In this embodiment, the depth of the recessed seat 24 substantially corresponds to the height of the projection 22. In other words, during the movement of the projection 22 along the direction S between its first position and its second position, and vice versa, the pad back plate 20 remains close to the face surface of the impact absorbing liner 12 (see FIG. 6). In the second position the magnetic attraction force exerted by the second magnetic element 28 on the first magnetic element 26 of the projection 22 is highly reduced and thus by exerting a low pull-out force T the cheek pad 16 can be detached from the helmet 1.

Figure 8:
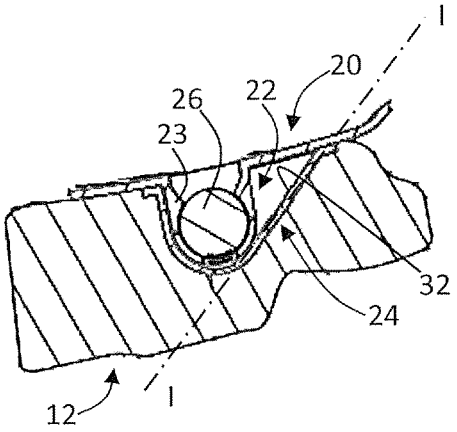
FIG. 8 is a figure similar to FIG. 5, but relating to a different embodiment of the present invention.
Figure 9:
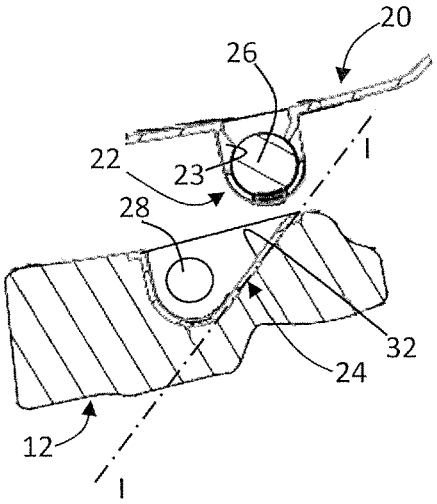
FIG. 9 is a figure similar to FIG. 8 showing how, in the embodiment of FIG. 8, the cheek pad can be released from the interior of the protective helmet.

Alternatively, as it is clearly shown in FIGS. 8-9, the recessed seat 24 has a bottom wall 32 which lays on a plane I inclined with respect to the interface surface between the pad back plate 20 and the impact absorbing liner 12.

In this embodiment, the depth of the recessed seat 24 substantially decreases along its extension, being greater in proximity of the second magnetic element 28.

In other words, during the movement of the projection 22 between its first position and its second position the pad back plate 20 is progressively spaced apart from the impact absorbing liner. During the sliding along the bottom wall 32 of the projection 22, the first magnetic element 26 is no longer attracted by the second magnetic element 28 and thus the cheek pad 16 can be released from the helmet 1.

Preferably, as it is shown in FIGS. 5-10, the second magnetic element 28 is arranged parallel to the side walls of the recessed seat 24, namely the walls extending orthogonal to the bottom wall 32 towards the interface surface.

More preferably, the second magnetic element 28 is arranged parallel to the side walls of the recessed seat 24, in proximity of a first end of the recessed seat.

Advantageously, the second magnetic element 28 can be housed in an appendix of the seat 24.

With reference to FIG. 17, the first magnetic element 26 arranged on the projection 22 can lay on an axis P1 essentially parallel to the pad back plate 20.

Consequently, as it is clearly shown in FIGS. 20 and 21, the second magnetic element 28 arranged in proximity of the recessed seat 24 lays on a plane P2 essentially parallel to the outer surface of the impact absorbing liner 12. In FIGS. 20-21 and in FIGS. 23-28, for convenience the interface surface between first and second magnets 26, 28 when they are faced to each other is indicated by the letter P.

Preferably, in this embodiment, the second magnetic element 28 is positioned underneath the bottom wall 32 of the recessed seat 24; the bottom wall laying on a plane substantially parallel to the interface surface P between the pad back plate 20 and the impact absorbing liner 12. In this embodiment, the magnetic attraction axis of the first magnet 26 and the magnetic attraction axis of the second magnetic element 28 are perpendicular to the interface surface between the pad back plate 20 and the impact absorbing liner 12.

Consequently, the magnetic attraction force between the first magnetic element 26 and the second magnetic element 28 is directed along an axis M which is orthogonal to the interface surface P between the pad back plate 20 and the impact absorbing liner 12 (see FIG. 20). Therefore, the axis M is also orthogonal to the axes P1 and P2.

The recessed seat 24 has preferably a width substantially equal to the width of the projection 22 so as to permit, also in this case, that the first magnetic element 26, during the moving of the projection 22 between the first position and the second position, maintains its orientation with respect to the second magnetic element 28.

In this embodiment, the depth of the recessed seat 24 substantially corresponds to the height of the projection 22. The length of the recessed seat 24 is greater than the length of the projection 22.

As shown in FIGS. 18-21 and 25-26, advantageously the recessed seat 24 can be provided in proximity of the second magnetic element 28 with a retention edge 34 suitable for engaging the projection 22 in the first position.

Said retention edge 34 substantially defines an undercut at the periphery of the portion of the seat 24 close to the second magnetic element 28.

The retention edge 34 has the function to prevent that in the first position the projection 22 can come out from the recessed seat 24 if a force orthogonal to the pad back plate 20 is applied to the cheek pad 16.

In this embodiment, to release the cheek pad 16 from the impact absorbing liner 12 the projection 22 needs to slide along a direction S parallel to the bottom wall 32 of the recessed seat 24 from the first position to the second position, so as to be disengaged from the retention edge 34 (see FIG. 25).

Once the projection 22 reaches the second position, by applying a low traction force T, orthogonal to the impact absorbing liner 12, it is possible to detach the projection 22 from the seat 24 so as to release the cheek pad 16 (see FIG. 26).

Alternatively, as shown in FIGS. 22-24 and 27-29, the recessed seat 24 can be provided with at least one inner protrusion 36 adapted to oppose the movement of the projection 22 from the first position to the second position.

Preferably, two inner protrusions 36 are provided at the side walls of the seat 24. These protrusions 36 are advantageously positioned at a middle portion of the recessed seat 24. The function of the protrusions 36 is to avoid that the projection 22 can move unintentionally from the first position to the second position.

As it is shown in FIGS. 27-28, the protrusions 36 oppose the sliding of the projection 22 along the direction S. To overcome the resistance offered by the protrusions 36, a force needs to be applied to the cheek pad 16.

Once the projection 22 reaches the second position, similarly to what it has been disclosed with reference to the embodiment of FIGS. 25-26, by applying a traction force T orthogonal to the impact absorbing liner 12 it is possible to detach the projection 22 from the seat 24 so as to release the cheek pad 16 (see FIG. 28).

As clearly shown in FIGS. 3-4, 18-19, 22 and 29, the protective helmet 1 can comprise a helmet back plate 30 coupled to the impact absorbing liner 12.

Preferably, the helmet back plate 30 is coupled to the impact absorbing liner 12 by means of co-injection or by means of mechanical fastening means. Advantageously, the helmet back plate 30 is flush with the interface surface between the impact absorbing liner 12 and the pad back plate 20.

If the helmet back plate 30 is fastened to the impact absorbing liner 12 by means of mechanical fastening means, the helmet back plate 30 is designed to be blocked inside a corresponding recessed area 45 of the impact absorbing liner 12 (see FIGS. 3 and 18).

The recessed seats 24 and the second magnetic elements 28 can be arranged in the impact absorbing liner 12.

Alternatively, the recessed seats 24 and the second magnetic elements 28 can be arranged on the helmet back plate 30. In detail, the second magnetic elements 28 can be inserted inside corresponding slots 44 provided on the helmet back plate 30, while the recessed seats 24 correspond to properly shaped cavities 46 provided in the helmet back plate 30. Once the helmet back plate 30 is fastened to the impact absorbing liner 12, slots 44 and cavities 46 can be housed inside corresponding voids 54, 56 created in the impact absorbing liner 12.

The helmet back plate 30 can be made of polymeric rigid material.

With reference to FIGS. 14-16, the provision of a separate helmet back plate 30 allows to vary the position of the cheek pads 16 on the protective helmet 1.

In detail, the helmet back plate 30 is fixed to the impact absorbing liner 12 by means of fixing pins 38 suitable for engaging corresponding fixing holes 40 provided on the helmet back plate and on the impact absorbing liner 12.

Advantageously, the helmet is provided with a plurality of fixing holes 40 allowing the helmet back plate 30 to be coupled to the impact absorbing liner 12 with different inclinations.

In the standard position, the cheek pads are preferably attached to the impact absorbing liner so that the protective helmet 1 can sit on the user's head with the inclination shown in FIG. 15. The lines F schematically define the standard field of visibility.

Riders often need to rotate the helmet to increase the upper visibility (see FIG. 16). In this new position the helmet must be stable and must not tend to come back to its original position.

In order to do this, the fixing pins 38 can be extracted from the fixing holes 40, so that the helmet back plate 30 can be rotated as shown in FIG. 14. Afterwards, it is possible to secure the helmet back plate 30 to the impact absorbing liner 12 by positioning the fixing pins 38 in different holes 40.

In this way, the cheek pads can be coupled in a rotated position with respect to their standard position with respect to the impact absorbing liner 12, so as to obtain, once the helmet is worn by the user, the configuration shown in FIG. 16.

As shown in FIG. 11, the recessed seats 24 are preferably disposed on the impact absorbing liner 12 parallel to each other. In particular, the recessed seats 24 are arranged along a direction I inclined of an angle $\alpha$ with respect to a tangential line B to the lower rim 11 of the helmet 1. The angle $\alpha$ is preferably between 40° and 60°. Consequently, in order to move the projections 22 between their first and second position a force S directed along the direction I needs to be applied to the cheek pads.

Advantageously, such an inclination avoids that the cheek pad can be released from the helmet if a downward force orthogonal to the lower rim is applied to the cheek pad. For example, a similar force can arise when the helmet is donned by the user.

With reference to FIGS. 12-13, advantageously the cheek pads 16 can comprise an emergency strap 42 which is accessible at a lower rim of the protective helmet 1 when the cheek pad 16 is coupled to the impact absorbing liner 12. The emergency strap 42 is preferably fastened to the padding layer 18.

Advantageously, as schematically shown in FIGS. 12 and 13, by applying on the emergency strap 42 a low force inclined with respect to the bottom rim of the helmet it is possible to move the projections 22 inside the recessed seats 24 from their first position to the their second position so that the magnetic force exerted by the second magnetic elements 28 over the first magnetic element 26 is reduced.

At the same time, the passage of the projection 22 from the first position to the second position causes a sliding of the cheek pad 16, the lower portion thereof becoming accessible. Once the cheek pad 16 protrudes from the lower rim of the helmet, it is possible to apply a force orthogonal to the interface surface between cheek pad and impact absorbing liner so as to permit that each projection comes out from the corresponding seat.

Such a movement is not hindered by the user's face since, as it is visible in FIG. 13, the cheek pad is no longer facing the user's face.

In this way, it is possible to detach the cheek pads without exerting any force on the user's neck.

It is clear now how the present invention allows to achieve the predefined objects.

The mutual arrangement of the recessed seats on the impact absorbing liner and of the projections on the pad back plate allows an easy removal of the cheek pads from the helmet in case of emergency.

In order to detach the projections from the seats, it is only needed that the projections slide inside their seats so as to space apart the corresponding magnetic elements.

The force necessary for removing the cheek pads is directed along the interface surface between the pad back plate and the impact absorbing liner and, due to the different shape and dimensions between projections 22 and recessed seats 24, a reduced friction arises between the projections 22 and the seats 24. Consequently, a lower decoupling force needs to be applied to the cheek pads in order to remove them from the helmet.

In this way the risk that a dangerous force is transferred to the neck of the users in case of an accident when the helmet must be removed, is reduced.

At the same time, the recessed seats and the projections are sized and shaped so as to guarantee a firm connection of the cheek pads to the impact absorbing liner during the normal use.

Unintentionally releasing is avoided by properly shaping the recessed seats.

Moreover, the protective helmet even if provided with recessed seats and projections has a simplified structure.

With regard to the embodiments of the protective helmet 1 described above, the person skilled in the art may, in order to satisfy specific requirements, make modifications to and/or replace elements described with equivalent elements, without thereby departing from the scope of the accompanying claims.

The invention claimed is:

1. A protective helmet comprising:

an outer shell;

an impact absorbing liner, positioned inside the outer shell;

a comfort liner positioned at an inner surface of the impact absorbing liner, so as to be in contact with a user's head during use of the protective helmet, the comfort liner comprising at least one cheek pad including a padding layer and a pad back plate, said at least one cheek pad being coupled to the impact absorbing liner by means of magnetic coupling means provided at the interface surface between the pad back plate and the impact absorbing liner, said magnetic coupling means comprising at least one projection, provided with a first magnetic element configured to be inserted inside at least one recessed seat in proximity of which a second magnetic element is arranged;

wherein the at least one recessed seat has a different size and shape with respect to said at least one projection, said at least one projection being adapted to move inside said at least one recessed seat between a first position, wherein the first magnetic element and the second magnetic element are faced to each other, so that the pad back plate is coupled to the impact absorbing liner, and a second position, wherein the first magnetic element and the second magnetic element are spaced apart, so that the pad back plate is releasable from the impact absorbing liner.

2. The protective helmet according to claim 1, wherein said at least one projection is provided at the back pad plate and said at least one recessed seat is provided at the impact absorbing liner.

3. The protective helmet according to claim 1, wherein said at least one projection extends from the pad back plate in a direction opposite to the padding layer.

4. The protective helmet according to claim 1, wherein said first magnetic element lays on an axis essentially orthogonal to the pad back plate, the magnetic attraction axis of said first magnet being parallel to the interface surface between the pad back plate and the impact absorbing liner.

5. The protective helmet according to claim 1, wherein said first magnetic element lays on an axis essentially parallel to the pad back plate, the magnetic attraction axis of said first magnet being perpendicular to the interface surface between the pad back plate and the impact absorbing liner.

6. The protective helmet according to claim 1, further comprising a helmet back plate coupled to the impact absorbing liner, said at least one recessed seat and said second magnetic element being arranged on the helmet back plate.

7. The protective helmet according to claim 6, wherein said helmet back plate is removably coupled to the impact absorbing liner by means of fixing pins designed to engage corresponding fixing holes provided on the helmet back plate and on the impact absorbing liner.

8. The protective helmet according to claim 7, said helmet is provided with a plurality of fixing holes allowing the helmet back plate to be coupled to the impact absorbing liner with different inclinations.

9. The protective helmet according to claim 6, wherein said pad back plate and the helmet back plate are made of polymeric rigid material.

10. The protective helmet according to claim 1, wherein said at least one recessed seat comprises a bottom wall laying on a plane essentially parallel to the interface surface between the pad back plate and the impact absorbing liner.

11. The protective helmet according to claim 1, wherein said at least one recessed seat comprises a bottom wall laying on a plane inclined with respect to the interface surface between the pad back plate and the impact absorbing liner.

12. The protective helmet according to claim 1, wherein said at least one recessed seat is provided in proximity of the second magnetic element with a retention edge suitable for engaging said at least one projection in the first position.

13. The protective helmet according to claim 1, wherein said at least one recessed seat is provided with at least one inner protrusion adapted to oppose the movement of at least one projection from the first position to the second position.

14. The protective helmet according to claim 1, wherein said at least one cheek pad comprises an emergency strap accessible at a lower rim of the protective helmet when the cheek pad is coupled to the impact absorbing liner.

15. The protective helmet according to claim 1, wherein said at least one recessed seat is arranged along a direction inclined of an angle with respect to a lower rim of the protective helmet, said angle being preferably between 40° and 60°.

* * * * *